United States Patent [19]

Utley

[11] Patent Number: 4,662,627

[45] Date of Patent: May 5, 1987

[54] CARTESIAN DIVING TOY

[76] Inventor: John D. Utley, 244 E. Pearson, Chicago, Ill. 60611

[21] Appl. No.: 775,665

[22] Filed: Sep. 13, 1985

[51] Int. Cl.[4] ..... A63H 23/08

[52] U.S. Cl. ..... 272/8 N; 446/155

[58] Field of Search ..... 272/8 R, 8 D, 8 N; 273/1 L; 446/153, 154, 155, 156, 159, 161

[56] References Cited

U.S. PATENT DOCUMENTS

| | | | |
|---|---|---|---|
| 968,900 | 8/1910 | Vanderbilt | 446/153 |
| 1,007,011 | 10/1911 | Sekikawa | 446/156 |
| 1,107,481 | 8/1914 | Boggs | 272/8 N |
| 1,204,132 | 11/1916 | Clemens | 272/8 N |
| 1,639,550 | 8/1927 | Bender | 446/156 |
| 2,509,112 | 5/1950 | Seaman | 272/8 N |
| 2,836,927 | 6/1958 | Warner | 446/155 |
| 3,009,286 | 11/1961 | Warner | 446/153 |
| 3,588,099 | 6/1971 | Todd | 272/8 N |
| 4,455,782 | 6/1984 | Seefluth | 272/8 N X |

*Primary Examiner*—Robert A. Hafer
*Assistant Examiner*—Arnold W. Kramer
*Attorney, Agent, or Firm*—Wood, Dalton, Phillips, Mason & Rowe

[57] ABSTRACT

A Cartesian diving toy having a transparent vessel for supporting a body of liquid. The vessel has an opening spanned by a flexible diaphragm for selectively applying increasing and decreasing pressure on the liquid in the vessel. A diving assembly is immersed in the liquid and is movable up and down within the liquid in response to changes in the pressure on the liquid. The diving assembly is in the form of a simulated hot-air balloon having a hollow shell for holding a quantity of gas. The shell has an opening at the bottom thereof through which a flexible straw is inserted for supplying the gas. A simulated gondola depends frm the bottom of the shell. A weight is provided within the shell for maintaining the balloon erect while immersed within the liquid.

18 Claims, 3 Drawing Figures

FIG. 1
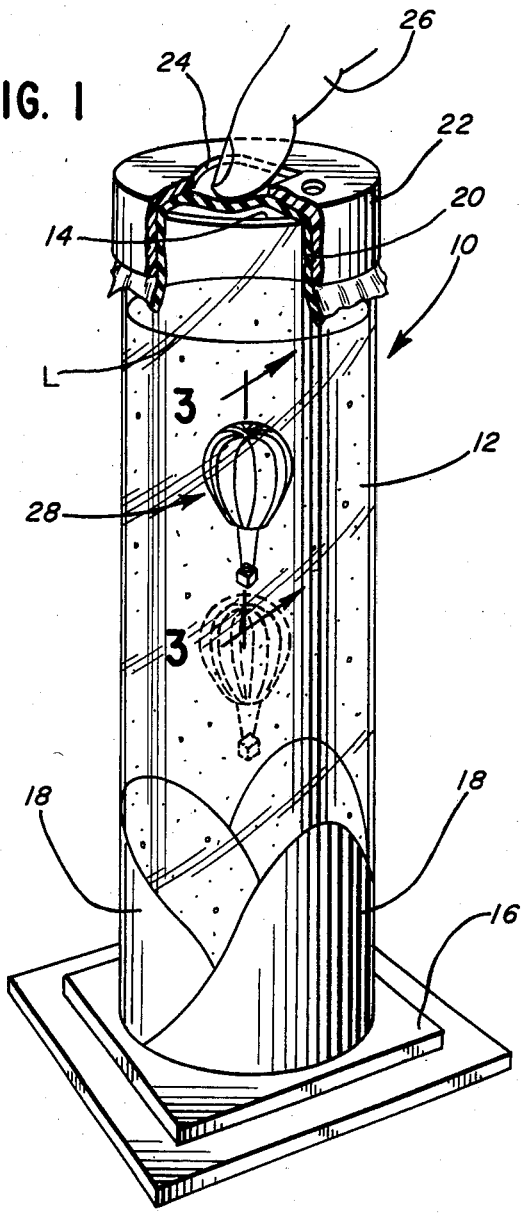
FIG. 2
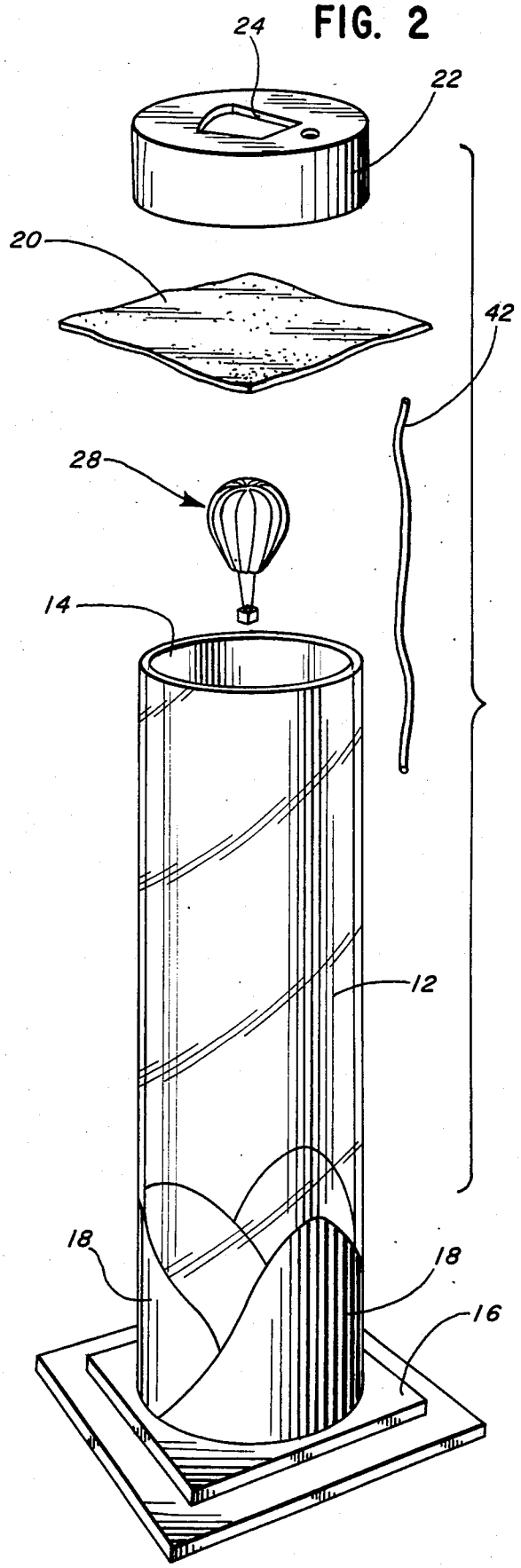
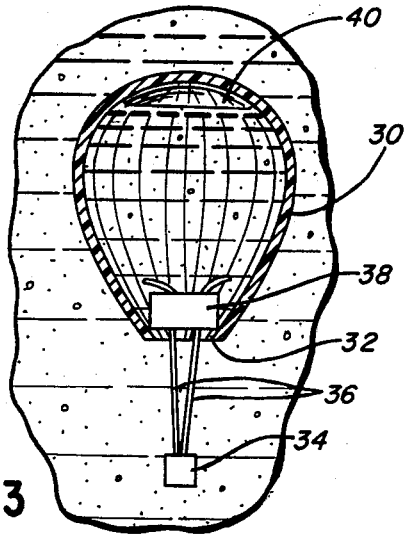
FIG. 3

CARTESIAN DIVING TOY

BACKGROUND OF THE INVENTION

This invention relates generally to an aquatic amusement device in the form of a Cartesian diving toy having a liquid-filled vessel with a diving assembly normally floating in the liquid but responsive to an increase in the pressure of the liquid to descend within the vessel. When the pressure is reduced or eliminated, the assembly ascends within the liquid and returns to its floating position at the top of the vessel.

Generally, devices have been designed on the Cartesian diving principle as toys for amusement purposes or as educational devices, with the diving assemblies in the form of simulated marine objects. In the field of toys, it most often is an object to simulate one form or another of real life objects or situations to enhance the utility or amusement of the device.

This often is quite difficult as, for example, will be apparent in designing a Cartesian diving toy. Furthermore, from a commercial standpoint, simple up-and-down movement of a diving assembly may initially raise the curiosity of a user, but it rapidly looses its ability to hold one's attention.

This invention is directed to a Cartesian diving toy simulating the assent and descent of a hot-air balloon. The very nature and shape of a hot-air balloon causes design problems in using the Cartesian diving principle while maintaining accurate simulation. For instance, the simulated balloon must be sufficiently lightweight to ascend and descend within the liquid. On the other hand, the "top heavy" construction of a simulated hot-air balloon presents problems in maintaining the balloon erect within the liquid.

Since most diving assemblies must have a given quantity of gas for effecting the Cartesian diving principle, a challenge can be created for a user to govern the motion of the diving assembly by varying the quantity of gas within the assembly or object.

This invention not only provides a novel diving toy of the character described, but it is adaptable for use as a kit in assembling, experimenting with and operating the toy on the Cartesian diving principle.

SUMMARY OF THE INVENTION

An object, therefore, of the invention is to provide a new and improved amusement device in the form of a Cartesian diving toy.

In the exemplary embodiment of the invention, the toy includes a transparent vessel for supporting a body of liquid. Means are provided for selectively applying increasing and decreasing pressure on the liquid in the vessel. A diving assembly is immersed in the liquid and is movable up and down within the liquid in response to changes in the pressure on the liquid. The diving assembly includes a simulated hot-air balloon having a hollow shell for holding a quantity of gas. The shell has an opening at the bottom thereof, and a simulated gondola depends from the bottom of the shell. The simulated gondola is in the form of a basket supported by wires releasably inserted through the bottom opening of the shell. Weight means is disposed within the shell for maintaining the balloon erect while immersed within the liquid.

Preferably, the shell of the balloon is thin-walled and fabricated of lightweight, molded plastic material. The shell is molded with elongated, rounded ribs extending vertically thereof to simulate balloon billows.

The vessel is provided as an upright tube having a closed bottom and an open top. A flexible diaphragm spans the open top of the tube. A cap holds the diaphragm in place, and the cap has an opening through which a user may insert a finger to flex the diaphragm for increasing and decreasing the pressure on the liquid.

The toy is provided in kit form, including the vessel tube for filling with liquid, such as water. The diaphragm and cap are provided of separate components. A flexible straw is provided for supplying the quantity of gas to the interior of the shell of the balloon, through the open top of the vessel tube. Thereby, a user can experiment with the quantity of gas to determine and govern the rate of descent and ascent of the balloon, as well as determining the precise quantity of gas which renders the movement of the balloon most effective.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a partially fragmented, perspective view of the Cartesian diving toy of the invention;

FIG. 2 is an exploded perspective view of the components of the toy, as in kit form; and FIG. 3 is a vertical section, on an enlarged scale, taken generally along line 3—3 of FIG. 1, showing the construction of the simulated hot-air balloon diving assembly.

DETAILED DESCRIPTION OF THE PREFERRED EMBODIMENT

Referring to the drawings in greater detail, and first to FIG. 1, a Cartesian diving toy is generally indicated 10 and includes an upright tube 12 defining a substantially transparent vessel for supporting a body of liquid. The tube has an open top 14 and a closed bottom defined by a supporting platform 16. Different colored decorative sections 18 may be provided at the bottom of tube 12 for simulating subjacent terrain, for instance. The tube is shown filled with a liquid, such as water, up to level "L".

Means are provided for selectively applying increasing and decreasing pressure on the liquid in the vessel. More particularly, a flexible diaphragm 20 spans open top 14 of tube 12. The diaphragm is sufficiently large to overlap the outside of the tube about its open top, and a cap 22 is provided for holding the diaphragm in place. The cap has an aperture 24 through which a user's finger 26 may be inserted for flexing the diaphragm and increasing and decreasing the pressure on the liquid within vessel 12.

A diving assembly, generally designated 28, is immersed in the liquid in tube 12 and is movable up and down within the liquid, as indicated by the full and dotted lines in FIG. 1, in response to changes in the pressure on the liquid. More particularly, the diving assembly is in the form of a simulated hot-air balloon.

Referring to FIG. 3 in conjunction with FIG. 1, the simulated hot-air balloon includes a shell 30 having an opening 32 at the bottom thereof. The shell is thin-walled and fabricated of lightweight material, such as of molded plastic material. For real-life affect, the shell is molded with elongated, rounded ribs extending vertically of the shell as an actual hot-air balloon is fabricated of sewn sections of material defining billows.

A simulated gondola depends from the bottom of shell 28. Specifically, the gondola includes a simulated basket 34 suspended by wires 36 depending from shell 30. The wires are fixed to basket 34 and diverge outwardly and upwardly through opening 32 of shell 30. The wires are of spring material so that the gondola can be assembled to shell 30 through the bottom opening thereof.

In simulating a hot-air balloon, the very "top-heavy" shape of such a balloon could cause problems in maintaining the diving assembly in a proper, erect position during its descent and ascent within the liquid. A delicate balance must be maintained between the materials of the assembly in order to maintain proper dimensional simulation of an actual hot-air balloon. Basket 34 cannot be too large and still appear realistic. Consequently, even fabricating basket 34 of the heaviest of materials will not maintain the assembly erect while maintaining a proper proportional size for the basket. Too small a quantity of gas in the shell will not effect proper movement. Preferably the bubble should cover substantially the entire interior of the crown of the shell. Otherwise, the balloon may float with an askew attitude. In addition, pressure changes are more easily registered on a large bubble. Consequently, weight means 38 is provided within shell 30 for maintaining the balloon erect while immersed within the liquid. The weight means may simply be a loose object forced through the opening 32 of the flexible shell. Or, the weight means may have a central opening through which wires 36 may expand, as shown in FIG. 3, for assembly purposes. The basket, wires and weight then may be assembled to the shell as a subassembly.

In order to effect the Cartesian diving principle, a quantity of gas 40 is held within shell 30, as shown in FIG. 3. As stated above, a significant novelty of the diving toy disclosed herein resides in its adaptability for use in kit form. For instance, tube 12, diaphragm 20, cap 22 and the above-described components of the diving assembly 28 which simulates a hot-air balloon all can be provided as separate components and assembled and operated by an individual. These components are shown in the exploded view of FIG. 2. Once tube 12 is filled with water, the assembled hot-air balloon diving assembly is immersed within the water. Means then are provided for supplying the quantity of gas 40 to the interior of shell 30. As shown in FIG. 2, this means comprises a flexible straw 42 which can be inserted through open top 14 of shell 12 and bent into the interior of shell 30 through bottom opening 32 thereof. In this manner, an individual can experiment with different quantities of gas and arrive at the most effective movement of the diving assembly within the liquid. This considerably enhances the ability of the toy to hold an individual's attention through continuing use and experimentation. The balance between the quantity of gas and the application of pressure to diaphragm 20 provides for continuing interest by a user of the toy.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A Cartesian diving toy having a transparent vessel for supporting a body of liquid, means for selectively applying increasing and decreasing pressure on the liquid in the vessel, and a diving assembly immersed in the liquid and movable up and down within the liquid in response to changes in the pressure on the liquid, the diving assembly comprising a simulated hot-air balloon having a hollow shell fabricated of lightweight material for holding a quantity of gas, the shell having a rounded dome and side walls tapering inwardly to an opening at the bottom thereof to simulate the hot-air balloon, a simulated gondola depending from the bottom of the shell, and weight means within the shell and distributed around said bottom opening for maintaining the balloon erect while immersed within the liquid.

2. The toy of claim 1 wherein the shell of the balloon is molded of plastic material.

3. The toy of claim 1 wherein the shell of the balloon has elongated, rounded ribs extending vertically along said side walls.

4. The toy of claim 1 wherein said pressure applying means comprises a flexible diaphragm at the top of the vessel.

5. The toy of claim 4 wherein the vessel comprises an upright tube having a closed bottom and an open top, said flexible diaphragm spanning the open top, and a cap for holding the diaphragm in place, the cap having an aperture through which a user may insert a finger to flex the diaphragm for increasing and decreasing the pressure on the liquid.

6. The toy of claim 1, including means for supplying said quantity of gas to the shell from exteriorly of the vessel.

7. The toy of claim 6 wherein said gas supplying means comprises a flexible straw.

8. The toy of claim 1 wherein said gondola comprises a simulated basket suspended by wires from the bottom of the shell.

9. A kit for assembling and operating a Cartesian diving toy, comprising:

a transparent vessel for filling with a body of liquid;

a diving assembly immersable in the liquid and movable up and down within the liquid in response to changes in the pressure on the liquid, the diving assembly simulating a hot-air balloon having a hollow shell fabricated of ligtweight material, the shell having a rounded dome and side walls tapering inwardly to an opening at the bottom thereof to simulate the hot-air balloon, a simulated gondola depending from the bottom of the shell, and weight means within the shell around said bottom opening for maintaining the balloon erect while immersed within the liquid;

means for supplying a quantity of gas to the interior of the shell while immersed in the liquid; and means for selectively applying increasing and decreasing pressure on the liquid in the vessel.

10. The kit of claim 9 wherein the vessel has an opening and said gas supplying means comprises a flexible straw insertable through the opening into the liquid.

11. The kit of claim 9 wherein said pressure applying means comprises a flexible diaphragm at the top of the vessel.

12. The kit of claim 11 wherein the vessel comprises an upright tube having a closed bottom and an open top, said flexible diaphragm spanning the open top, and a cap for holding the diaphragm in place, the cap having an aperture through which a user may insert a finger to flex the diaphragm for increasing and decreasing the pressure on the liquid.

13. The kit of claim 12, including means for supplying said quantity of gas to the shell from exteriorly of the vessel.

14. The kit of claim 13 wherein said gas supplying means comprises a flexible straw.

15. The kit of claim 9 wherein said gondola comprises a simulated basket suspended by wires from the bottom of the shell.

16. The kit of claim 15 wherein said wires are fixed to the simulated basket and spring biased outwardly therefrom for releasably mounting the basket in the opening at the bottom of the balloon.

17. A Cartesian diving toy, comprising:

a generally transparent vessel in the form of an upright tube having a closed bottom and an open top for supporting a body of liquid;

a flexible diaphragm spanning the open top of the tube;

a cap for holding the diaphragm in place across the top of the tube, the cap having an opening through which a user may insert a finger to flex the diaphragm for selectively increasing and decreasing pressure on the liquid in the tube;

a diving assembly immersable in the liquid and movable up and down within the liquid in response to changes in the pressure on the liquid, the diving assembly comprising a simulated hot-air balloon having a hollow shell of lightweight material for holding a quantity of gas, the shell having a rounded dome and side walls tapering inwardly to an opening at the bottom thereof to simulate the hot-air balloon, a simulated gondola depending from the bottom of the shell, and weight means within the shell and distributed around said bottom opening for maintaining the balloon erect while immersed within the liquid; and a flexible straw for supplying said quantity of gas to the shell through the open top of the upright tube.

18. The toy of claim 17 wherein said gondola comprises a simulated basket suspended by wires from the bottom of the shell.

* * * * *